US006733042B1

(12) United States Patent
Klemetti

(10) Patent No.: US 6,733,042 B1
(45) Date of Patent: May 11, 2004

(54) SKI STICK

(76) Inventor: Viljo Klemetti, Ritoniementie 14, FIN-40250 Jyväskylä (FI)

( * ) Notice: Subject to any disclaimer, the term of this patent is extended or adjusted under 35 U.S.C. 154(b) by 53 days.

(21) Appl. No.: 09/980,033

(22) PCT Filed: Jun. 7, 2000

(86) PCT No.: PCT/FI00/00506

§ 371 (c)(1),
(2), (4) Date: Nov. 27, 2001

(87) PCT Pub. No.: WO00/76604

PCT Pub. Date: Dec. 21, 2000

(30) Foreign Application Priority Data

Jun. 11, 1999 (FI) ..... 991337

(51) Int. Cl.[7] ..... A63C 11/22
(52) U.S. Cl. ..... 280/819; 280/821
(58) Field of Search ..... 280/819, 821, 280/816, 824, 820, 809; 135/65, 71, 72, 73; D21/775

(56) References Cited

U.S. PATENT DOCUMENTS 3,879,048 A * 4/1975 Penney ..... 280/821
4,068,610 A * 1/1978 Tesan ..... 440/101
D349,144 S * 7/1994 Greene ..... D21/775
5,348,346 A * 9/1994 Unger ..... 280/819
5,611,571 A * 3/1997 Manninen et al. ..... 280/819
5,671,765 A * 9/1997 Hagberg, Jr. ..... 135/68
5,687,991 A * 11/1997 Gairdner ..... 280/826
5,938,240 A * 8/1999 Gairdner ..... 280/826

FOREIGN PATENT DOCUMENTS

| | | |
|---|---|---|
| DE | 29706693 | 9/1998 |
| DE | 29713414 | 1/1999 |
| FR | 2672811 | 8/1992 |

* cited by examiner

*Primary Examiner*—Brian L. Johnson
*Assistant Examiner*—Brian L Swenson
(74) *Attorney, Agent, or Firm*—Fildes & Outland, P.C.

(57) ABSTRACT

A ski stick includes an oblong shaft and a handle set on its upper end for the skiier's hand and a gripping part formed at its lower end. Below the handle the ski stick includes an elbow support. It is set in a sloping position on the upper part of the shaft and is set to receive the pressure of the skiier's forearm and to transmit it to the shaft.

6 Claims, 3 Drawing Sheets

SKI STICK

TECHNICAL FIELD

The invention relates to a ski stick, which includes an oblong shaft and a handle set on its upper end for the skiier's hand and a gripping part formed at its lower end.

BACKGROUND OF THE INVENTION

A ordinary ski stick encompasses an oblong straight stick, onto the lower end of which a suitable gripping part is formed and a handle is formed on its upper end. The gripping part is normally a spike formed at the end of the stick and a ring placed on top of it. The handle is composed of a piece formed on the upper end of the stick, which has a perform for the finger grip. The handle normally also includes a fastening loop. Certain patents relate to the forming of the handle and to the longotudinal flexibility of the ski stick, but such solutions have not become general due to their small advantages.

Traditionally, the ski stick is caused to have a longitudinal propulsion force. The wrist works as a articulated point through which a force is transmitted to the ski stick that is then directed in the longitudinal direction of the stick. When effecting thrusts with a traditional ski stick, the greatest exertion takes place in the extensor and in the muscles in the back.

Out of the drawbacks that occur when using traditional ski sticks, the following can be mentioned:

1. The arm does not gain any support between the palm of the hand and the shoulder. The lever arm by which the force is transmitted from the shoulder onto the ski stick is very long, whereby the force stays very small especially in the beginning of the thrust/pull.
2. The skiier must constantly stress his extensor and cannot rest his arm at any stage of the thrust.
3. The skiier can only use few muscles when thrusting with the ski stick.
4. The skiier cannot use gravity to his advantage with the ski sticks without at the same time having to stress the muscles of his arm intensely.

SUMMARY OF THE INVENTION

The object of this invention is to achieve a new kind of ski stick that makes possible the use of new muscle groups in skiing and that removes or reduces the above mentioned disadvantages of known ski sticks.

A ski stick, which includes an oblong stiff shaft and a handle set on its upper end for the skier's hand and a gripping part formed at its lower end, is characterized in that an elbow support belongs below the handle but at the upper end of the shaft, which support is set to slope obliquely upwards in the direction of the skiing and is set to receive the pressure of the skier's forearm, to form the bending moment and to transmit these to the shaft. The elbow support projects from the uniform and essentially straight stick formed by the shaft that extends to the handle. A slanting part is formed onto the upper part of the shaft, which slanting part carries the elbow support and whereby the handle is placed at the upper part of the slanting part when seen in the skiing position. The elbow support is set at a 30°–70° angle in relation to the main part of the shaft.

The moment of gyration of the shaft is formed essentially greater in the level set by the shaft and the elbow support than in the transverse level. The ski stick includes a controlling device articulated below the handle and intended to be tied onto the skier's forearm, set onto the elbow support in such a manner that it will always guide the forearm against the elbow support. The elbow support is tied onto the shaft with a joint and supported from there with a spring organ.

When skiing with a ski stick according to the invention, the forearm is pressed against the elbow support of the ski stick when the stick has been taken to its forward position. Thus when pushing against the surface formed by the elbow support of the ski stick, it is possible to bend the arm and to get the shoulder to move onwards with much force. At this stage the upper arm is almost in the same direction as the ski stick, forming together with the stick a straight support onto which the skier can put some weight and thereby achieve a forward going lean. During the lean, the arm can rest. Then the forearm starts to stress the arm forward and to push the skier forward. The whole thrust stage is much more powerful than with the traditional type of skiing.

The greatest advantage of the invention could be said to be that it is possible while skiing to use wholly new muscle groups and the skiing process requires less power. According to one profitable form of application, the elbow support is formed onto a projection that comes out from the otherwise uniform stick. As another main form of application, the shaft forms a forward going bend in which the sloping part of the shaft, situated below the handle, bears the elbow support. In addition to these there are forms in between, in which the shaft is bent and the elbow support projects backwards from the rest of the stick. All these forms have in common the fact that with the help of this kind of elbow support it is possible to form a strong bending stress onto the ski stick in addition to the compression stress that only existed before.

The other advantages and application forms of the invention become clear later in connection with the examples of application that are explained in the following with the help of the accompanying figures.

DETAILED DESCRIPTION OF THE INVENTION

Figure 1:
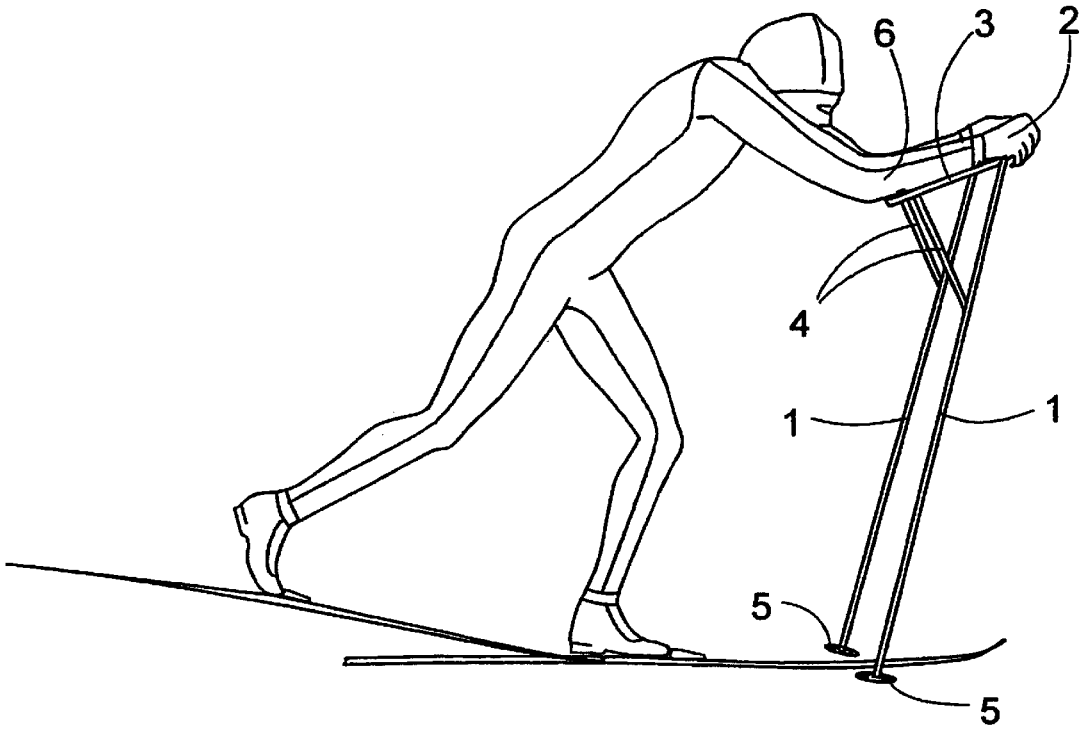
FIG. 1 presents the use of the ski stick according to the invention.

The ski stick according to the invention can be used in a versatile manner in different types of skiing. In FIG. 1, the skiier is skiing with the so-called one-kick uniform skiing and is at the thrust stage. The ski stick according to the invention includes the traditional parts: shaft 1, handle 2 and ring 5, below which a gripping spike is situated. In the ski stick according to the invention an elbow support 3 is placed below the handle 2, the support being stiffly tied to the shaft 1 and supported onto it by an additional support 4. In the style of skiing presented in the figure, new muscle groups can be taken into use whilst letting others rest.

Figure 2A:
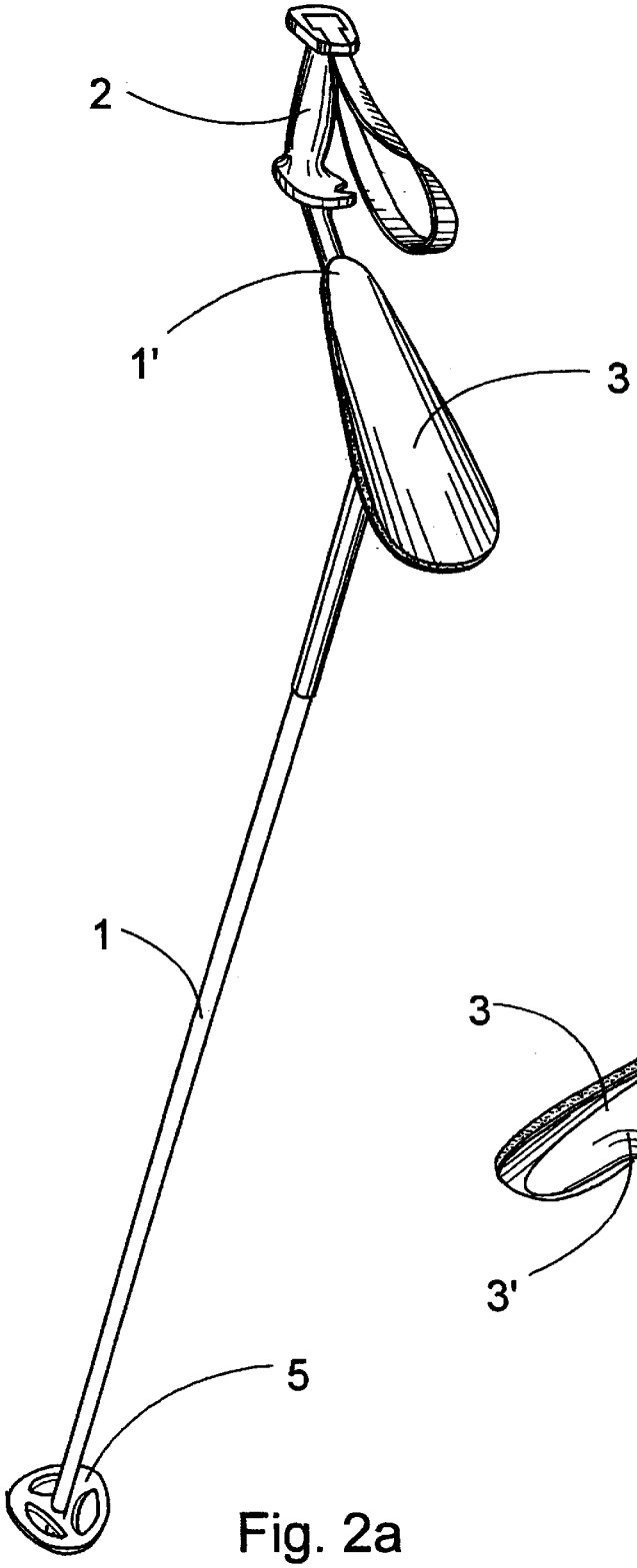
FIGS. 2*a* and 2*b* present one ski stick according to the invention in more detail.
Figure 2B:
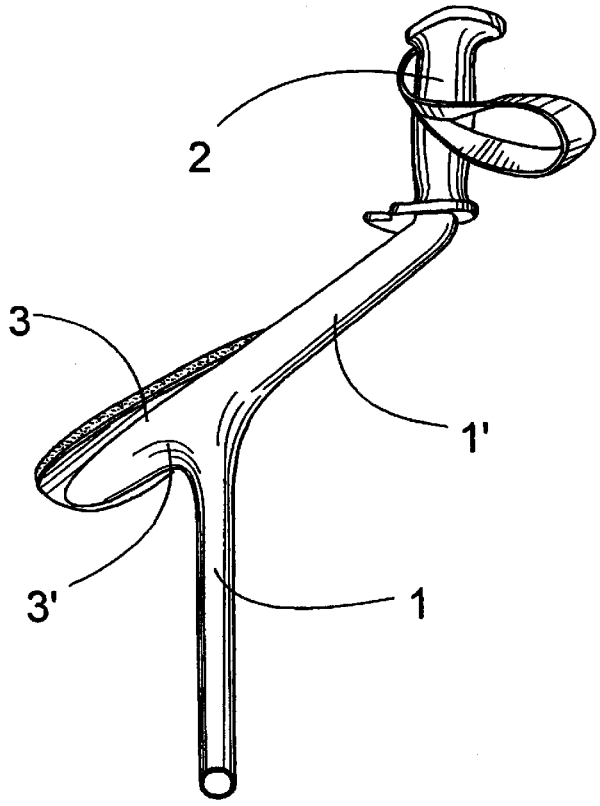

In the ski stick according to FIGS. 2*a* and 2*b,* a bend has been formed to the upper end of shaft 1, in which the sloping part 1' carries the elbow support 3. In addition to this, the elbow support extends somewhat backwards by the sloping part whilst part 3' carries the elbow support from its rear part.

Figure 3A:
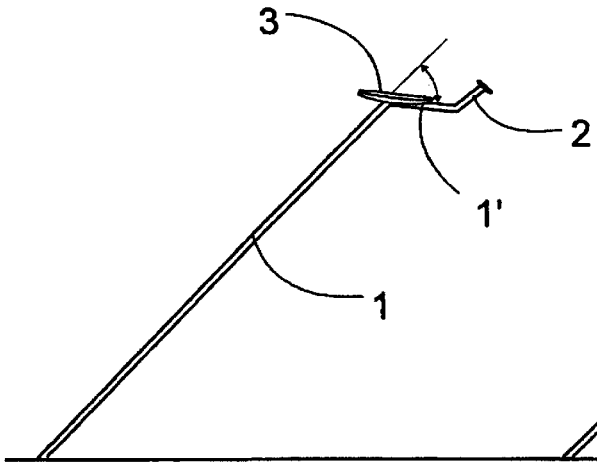
FIGS. 3*a* and 3*b* present the two main application forms of the ski stick according to the invention schematically.
Figure 3B:
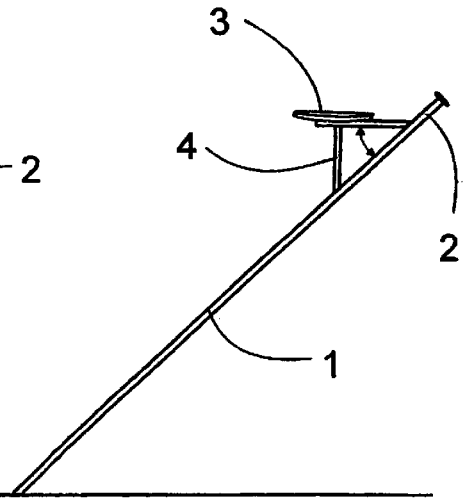

As in FIGS. 3*a* and 3*b,* the elbow support can be formed either onto the bent part of the shaft or by extending it backwards from the otherwise straight ski stick. In accordance with FIGS. 2*a* and 2*b,* a combination of these can also be used. With reference to FIG. 3*a,* the elbow support 3 forms together with the shaft 1 or its continuance a point angle that is 30°–70°, most preferably 45°–55°. It is advantageously possible to regulate this angle. The angle can even be 90° on particularly short ski sticks.

Figure 4:
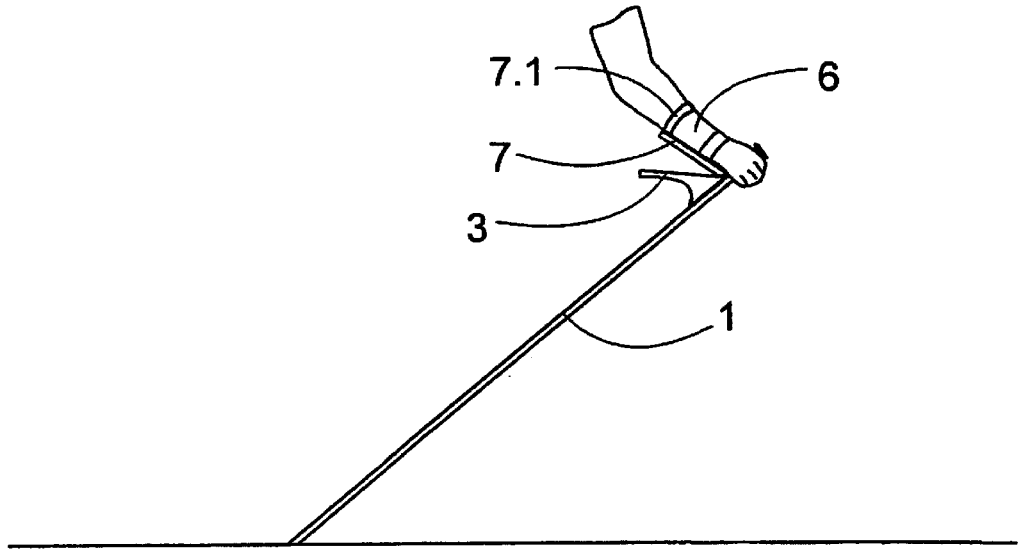
FIG. 4 present the ski stick according to the invention equipped with an additional controlling device.

With the form of application according to FIG. 4 it is ascertained that the forearm 6 always falls on the elbow support 3, which could othewise be difficult in the case of a non-experienced skiier or when skiing fast. In accordance with the figure, the ski stick includes a controlling device 7 that is preferably attached onto the skiier's forearm 6 with a suitable straps 7.1. The controlling device 7 has been articulated to the ski stick with the help of joint 8 from below the handle and from the front part of the elbow support 3, whereby it is forced to turn in the level formed by the shaft 1 and the elbow support 3 and will always guide the forearm 6 against the elbow support 3. The joint 8 forces the controlling device 7 always to turn in the level set by the middle line of the shaft 1 and the elbow support 3.

Figure 5A:
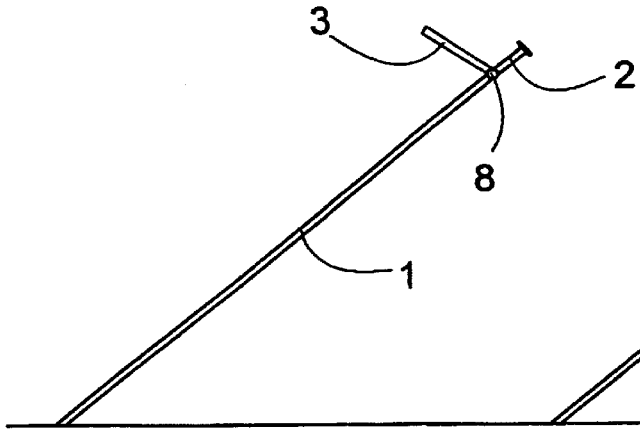
FIGS. 5*a* and 5*b* present the ski stick equipped with a flexible elbow support.
Figure 5B:
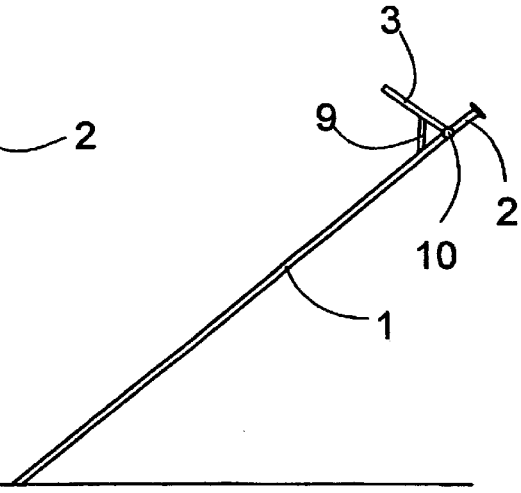

In the previous forms of application, the elbow support has been stiffly attached to the shaft. In the application form according to FIGS. 5*a* and 5*b,* the elbow support 3 is tied to the shaft with the help of a spring organ. In the form of application in FIG. 5*a,* a suitable coil spring or other element is used to tie the elbow support 3 onto the shaft 1. In the form of application in FIG. 5*b,* the elbow support 3 is tied onto the shaft with the help of a joint 10 and separately supported from the shaft with a spring 9. Such a suspended elbow support makes the preservance of the traditional style of skiing as far as possible better possible, because the forearm is able to turn close to the direction of the shaft.

Figure 6:
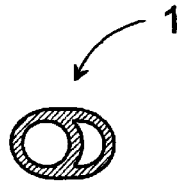
FIG. 6 presents a profitable profile of the shaft of a ski stick according to the invention.

The ski stick according to the invention creates a strong bending moment onto the shaft, due to which the shaft is profitably formed in a new way. In accordance with FIG. 6, the profile of the shaft is formed somewhat oblong in the level of the shaft and the elbow support, whereby it is able to endure the bending moment much more in this direction than in the transverse direction. The moment of gyration of the shaft can also be grown with the help of a support structure such as a wire rope tautened between the ring and the handle formed in the said level. The ski stick according to the invention can also be formed by making the elbow support into an additional part to the traditional ski stick.

The optimum length of the elbow support is individual. The support must be at least long enough for the skiier to be able to press it to the essential degree with his upper arm. On the other hand, it need probably not be as long as the upper arm. A elbow support of full length that is as long as the upper arm gives a better support, but is probably more impractical than the elbow support of somewhat shorter dimensions.

The terms "ski stick" and "skiier" must here be interpreted widely. The invention is naturally also suitable to stick walking and to sticks used in connection with roller skates/skiis.

What is claimed is:

1. A ski stick, which includes an oblong stiff shaft and a handle set on its upper end for the skier's hand and a gripping part formed at its lower end, characterized in that an elbow support is located below the handle and at the upper end of the shaft, the elbow support is fixed to the shaft and having a forearm catching surface for intermittently catching a skier's forearm as the forearm falls on the elbow support during transmission of force through the ski stick during skiing, which elbow support slopes obliquely upwards in the direction of skiing and adapted to receive the pressure of the skier's forearm, to form a bending moment and to transmit the pressure of the skier's forearm to the shaft.

2. Ski stick according to patent claim 1, characterized in that the elbow support projects from the uniform and essentially straight stick formed by the shaft that extends to the handle.

3. Ski stick according to patent claim 1, characterized in that a slanting part is formed onto the upper part of the shaft, the slanting part carries the elbow support and whereby the handle is placed at the upper part of the slanting part when seen in the skiing position.

4. Ski stick according to patent claim 1, characterized in that the elbow support is set at a 30°–70° angle in relation to the main part of the shaft.

5. Ski stick according to patent claim 1, characterized in that the profile of the shaft is formed oblong in the level of the shaft and the elbow support.

6. Ski stick according to patent claim 1, characterized in that the ski stick includes a controlling device articulated below the handle and intended to be tied onto the skier's forearm, set onto the elbow support in such a manner that it will always guide the forearm against the elbow support.

* * * * *